US008453355B2

(12) United States Patent
Kay

(10) Patent No.: US 8,453,355 B2
(45) Date of Patent: Jun. 4, 2013

(54) COVER FOR CLEATED SHOES

(75) Inventor: Richard Keith Kay, Encinitas, CA (US)

(73) Assignee: Cleatskins, LLC, Encinitas, CA (US)

( * ) Notice: Subject to any disclaimer, the term of this patent is extended or adjusted under 35 U.S.C. 154(b) by 618 days.

(21) Appl. No.: 12/123,797

(22) Filed: May 20, 2008

(65) Prior Publication Data

US 2009/0288314 A1 Nov. 26, 2009

(51) Int. Cl.
*A43B 5/00* (2006.01)

(52) U.S. Cl.
USPC ..... 36/135; 36/7.1 R

(58) Field of Classification Search
USPC ..... 36/7.1 R, 7.3, 135, 58.5, 58.6, 4, 36/97
See application file for complete search history.

(56) References Cited

U.S. PATENT DOCUMENTS

| | | | | | |
|---|---|---|---|---|---|
| 1,204,796 | A | * | 11/1916 | Lockwood | 36/7.5 |
| 1,340,356 | A | * | 5/1920 | Yarnell et al. | 36/7.5 |
| 1,685,538 | A | * | 9/1928 | Glidden et al. | 36/30 R |
| 1,701,611 | A | * | 2/1929 | Glidden et al. | 36/32 R |
| 1,704,187 | A | * | 3/1929 | Glidden et al. | 36/32 R |
| 2,076,316 | A | * | 4/1937 | Beals, Jr. | 36/7.5 |
| 2,825,155 | A | * | 3/1958 | Hines | 36/58.6 |
| 2,860,425 | A | * | 11/1958 | Jackson | 36/7.3 |
| 3,006,084 | A | * | 10/1961 | Le Compte | 36/7.3 |
| 3,026,635 | A | * | 3/1962 | Slade | 36/7.3 |
| 3,313,047 | A | * | 4/1967 | Svien | 36/7.3 |
| 3,566,488 | A | * | 3/1971 | Pilarski | 36/7.5 |
| 3,643,352 | A | * | 2/1972 | Adair | 36/7.3 |
| 3,812,603 | A | * | 5/1974 | Goodman | 36/136 |
| 3,821,858 | A | * | 7/1974 | Haselden | 36/135 |
| 3,827,166 | A | * | 8/1974 | Goodman | 36/135 |
| 3,913,243 | A | * | 10/1975 | Arnold et al. | 36/135 |
| 4,183,157 | A | * | 1/1980 | Counselman | 36/135 |
| 4,944,099 | A | * | 7/1990 | Davis | 36/97 |
| 5,315,767 | A | * | 5/1994 | Bradbury | 36/7.1 R |
| 5,367,794 | A | * | 11/1994 | Adelstein et al. | 36/135 |
| 5,396,717 | A | * | 3/1995 | Bell | 36/7.3 |
| 5,425,186 | A | * | 6/1995 | Hoyt | 36/97 |
| 5,548,910 | A | * | 8/1996 | Klingseis | 36/135 |

(Continued)

FOREIGN PATENT DOCUMENTS

| | | | |
|---|---|---|---|
| JP | 2001-149108 | A | 6/2001 |
| JP | 2007-116001 | A | 5/2007 |
| KR | 10-20060008659 | | 1/2006 |

OTHER PUBLICATIONS

International Search Report for International Application No. PCT/US2009/044654, Publication No. WO 2009/143230 A3, dated Jan. 7, 2010.

*Primary Examiner* — Marie Patterson
(74) *Attorney, Agent, or Firm* — Christie, Parker & Hale, LLP

(57) ABSTRACT

A cover for cleated shoes. The shoe cover has a ball area, a heel area, and a mid-foot area between the ball area and the heel area. At least the mid-foot area is formed of stretchable material and is thinner than the material forming the ball area and heel of the sole. An internal support member is located internally in the ball area and/or heel area of the sole. An upper portion extends upward from the sole portion and defines a toe cup and a heel cup, with the upper portion being formed of stretchable material in at least the mid-foot area, and which has an opening formed therein to allow shoe and/or foot access to the shoe cover.

16 Claims, 12 Drawing Sheets

U.S. PATENT DOCUMENTS

| | | | | | |
|---|---|---|---|---|---|
| 5,950,333 | A * | 9/1999 | Tsen | 36/7.1 R |
| 5,992,053 | A * | 11/1999 | Hansen | 36/7.5 |
| 6,044,578 | A * | 4/2000 | Kelz | 36/7.5 |
| 6,138,385 | A * | 10/2000 | Jungkind et al. | 36/97 |
| 6,154,982 | A * | 12/2000 | Bell et al. | 36/7.6 |
| 6,167,639 | B1 * | 1/2001 | Ventura | 36/44 |
| 7,188,438 | B1 * | 3/2007 | Bowen | 36/7.1 R |
| 7,627,963 | B2 * | 12/2009 | Kilgore | 36/97 |
| 7,779,560 | B2 * | 8/2010 | Kay | 36/135 |
| 2003/0136026 | A1 * | 7/2003 | Crary | 36/58.5 |
| 2004/0074113 | A1 * | 4/2004 | Kim et al. | 36/135 |
| 2006/0005425 | A1 | 1/2006 | Votolato | |
| 2007/0006490 | A1 * | 1/2007 | Kay | 36/135 |
| 2008/0301974 | A1 * | 12/2008 | Bowen et al. | 36/7.6 |

* cited by examiner

COVER FOR CLEATED SHOES

SUMMARY OF THE INVENTION

This invention relates to the field of footwear, and more particularly, to a shoe cover that protects cleats, studs and/or spikes on footwear when not being used on grassy or soft ground surfaces, as well as protecting floor surfaces from being damaged by the cleats, studs and/or spikes. Hereinafter, the term cleat will be used, but this is not intended to be limiting.

In a variety of sports such as track and field, baseball, football, soccer, rugby, lacrosse and golf, to name a few, shoes are provided with cleats or spikes extending downwardly from the bottom of the soles. Cleats or spikes were previously made of metal, but now are more commonly made of hard plastic. These cleats or spikes provide the user with additional traction on sport fields and tracks. However, the cleats can be damaged by walking on abrasive and hard surfaces such as sidewalks and streets. Moreover, the cleats can damage more delicate floor surfaces such as wood floors and interior carpeting.

Accordingly, players commonly bring their sports shoes with cleats or spikes, along with a pair of walking shoes without cleats that the player can wear when not using the shoes with cleats. However, sometimes players forget to bring cleatless or spikeless shoes or do not to remove their shoes with cleats after use on the field and thus the cleats either wear excessively fast, or the ground surface, such as the carpet of a car or the floor of a building, becomes dirty or scraped.

It would accordingly be useful to have a cleat protector shoe cover that protects both the cleats or spikes on the cleated or spiked shoes as well as wood floor, carpeting, etc. and which does so in an economical, comfortable and functional manner.

DETAILED DESCRIPTION OF THE INVENTION

Figure 1:
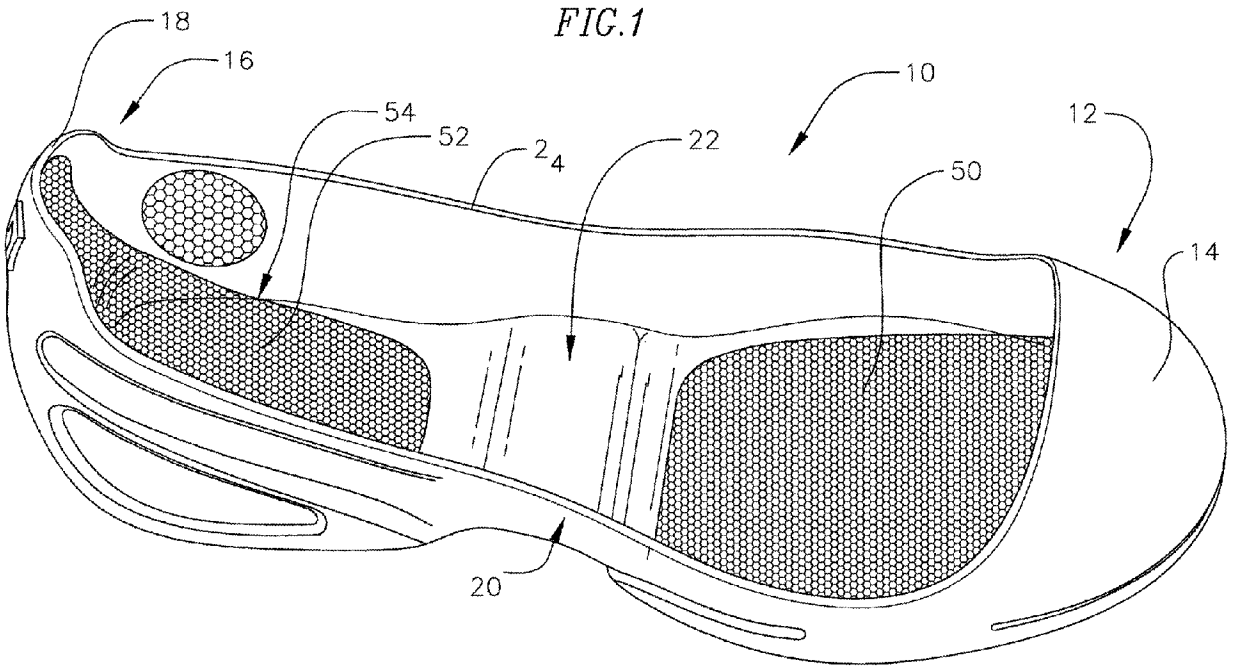
FIG. 1 is a top isometric view showing the inside of a first exemplary shoe cover.
Figure 2:
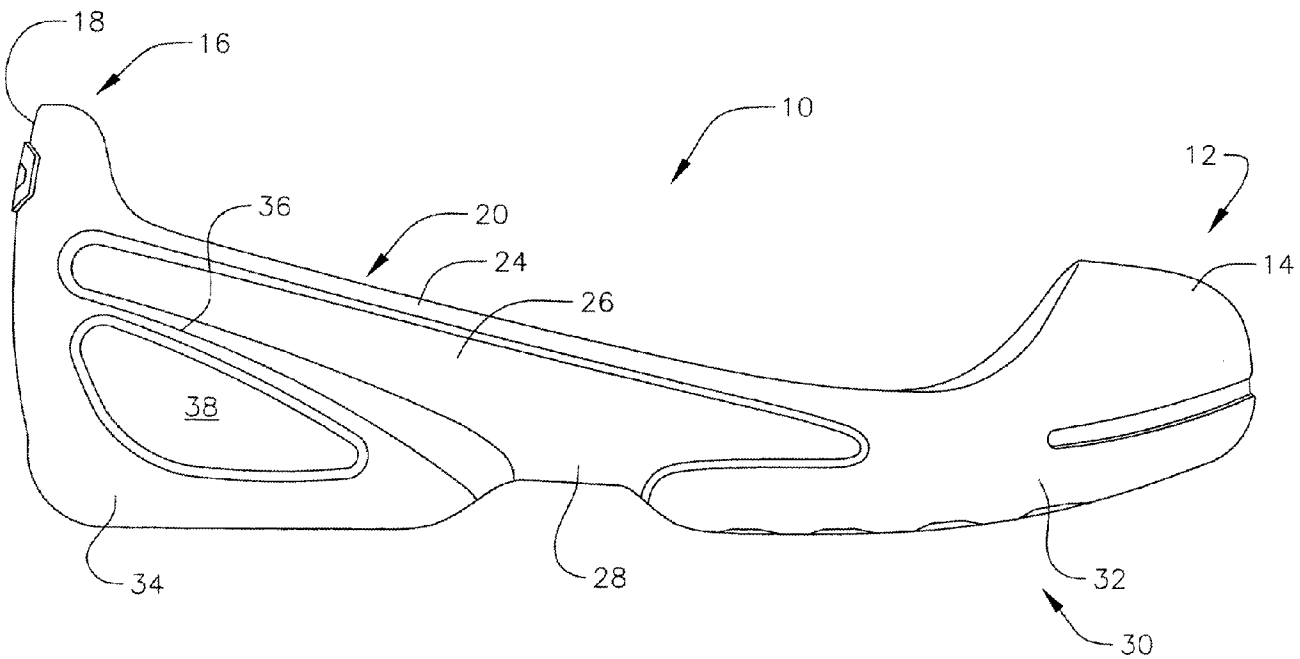
FIG. 2 is a side view of the exemplary shoe cover of FIG. 1.

FIG. 1 is a top isometric view showing the inside of a first exemplary shoe cover 10 and FIG. 2 is a side view of same. The first exemplary shoe cover 10 can preferably be formed in a one piece design out of resilient plastic or rubber material that both are flexible and durable. As an example, the following types of materials can be used to form the shoe cover: Petroleum based rubbers, natural rubbers, silicon rubbers and stretch fabrics with or without elastic coatings. At a toe section 12 at the front of the shoe cover, a toe cup 14 is formed that will cup the toe region of the user's shoes. At a heel portion 16, optionally a high heel riser portion 18 is provided to connect with the top arch of the cleated shoe's heel and is also helpful as a grip to help don and remove (doff) the shoe cover. Running along a top edge 20 of the shoe cover opening 22 is a top line 24 that is formed thicker than side regions 26 and a midfoot region 28. Because more material is provided in this thicker top line 24, it is stiffer and exerts more tension to create a gripping pressure to keep the shoe cover 10 in connection with a user's foot and shoe when inserted into the shoe cover 10 through the shoe cover opening 22. The thinner side regions 26 and a midfoot region 28 (in the area of the arch), by virtue of being formed with thinner rubber or plastic material, will stretch more and allow the shoe cover 10 to accommodate differing shoe sizes, lengths, widths, and shapes. The shoe cover 10 has a sole area 30. At the ball region 32 and at the heel region 34 of the sole 30, the sole material can preferably be thicker to help control side to side sole movement. For example, the sole thickness in the ball area 32 and heel area 34 can be of a desired thickness, such as about 5 to 10 mm, and more preferably about 6.5 to 7 mm, although other thicknesses can be used. The thicknesses in different areas of the shoe cover will depend on the nature of the material used to make the shoe cover and the shoe size. For example, a small sized shoe cover made for very young children, need not be as thick as larger shoes for adults. Optionally wrapping around the heel portion 16 is an additional band of thicker material 36, which can be provided to stabilize the heel. To save material and weight, a thinner area 38 is optionally provided at sides of the heel region. As shown in the inside of shoe cover 10, a traction area 50 can optionally be formed in the fore foot area and a traction area 52 can be formed in the heel area 54. This can help to prevent sliding of cleats. In addition, the inside surface of the high heeled back portion 18 preferably has traction areas in its center, which will help to grip the back of the cleat heel. The traction can be enhanced by providing a raised and/or depressed pattern on the inside surface of the shoe cover in these areas of the shoe.

Figure 3:
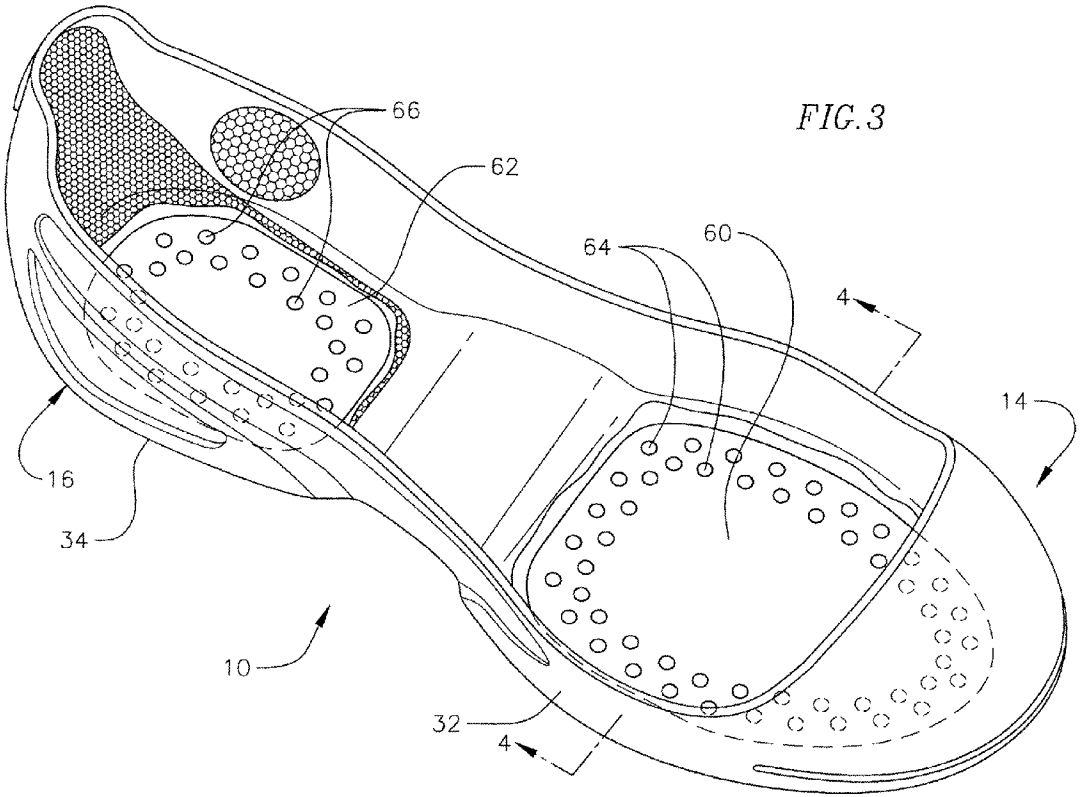
FIG. 3 is a partially exposed top isometric view showing the internal structure of the exemplary shoe cover of FIG. 1.

FIG. 3 is partially exposed top isometric view showing the internal structure of the exemplary shoe cover 10 of FIG. 1. Optionally, internal support members 60 and 62 are located in ball region 32 and heel region 34 of the sole, and are molded into the sole during formation of the shoe cover. The internal support members 60 and 62 can be formed as rigid or semi-rigid molded plates, as a section of mono filament mesh or a section of fabric, and the like. The function of the internal support members 60 and 62 are to strengthen the sole in the region where the cleats of a wearer's cleated shoes will impinge on the inside of the sole and to spread the load of the point-load pressure of the cleat tips to a broader area of the sole. This creates the desirable effect of reducing wear and load on concentrated areas. If a stiffer shoe cleat sole cover is desired, the internal support members 60 and 62 can be formed of thicker and/or stiffer material, such as plastic or hard rubber. In the case of molded internal support members 60 and 62, a series of apertures 64 and 66, respectively, can optionally be formed therein. These apertures 64, 66 will allow rubber to continue through the internal support members and thereby achieve improved anchoring of the molded internal support members 60 and 62 in the sole. In the case of the internal support members 60 and 62 being formed of a section of mono filament mesh or a section of fabric, by selecting the desired weave of the fabric, there may be some natural passage of material through the filaments. If not, apertures can also be formed therein.

Figure 4:
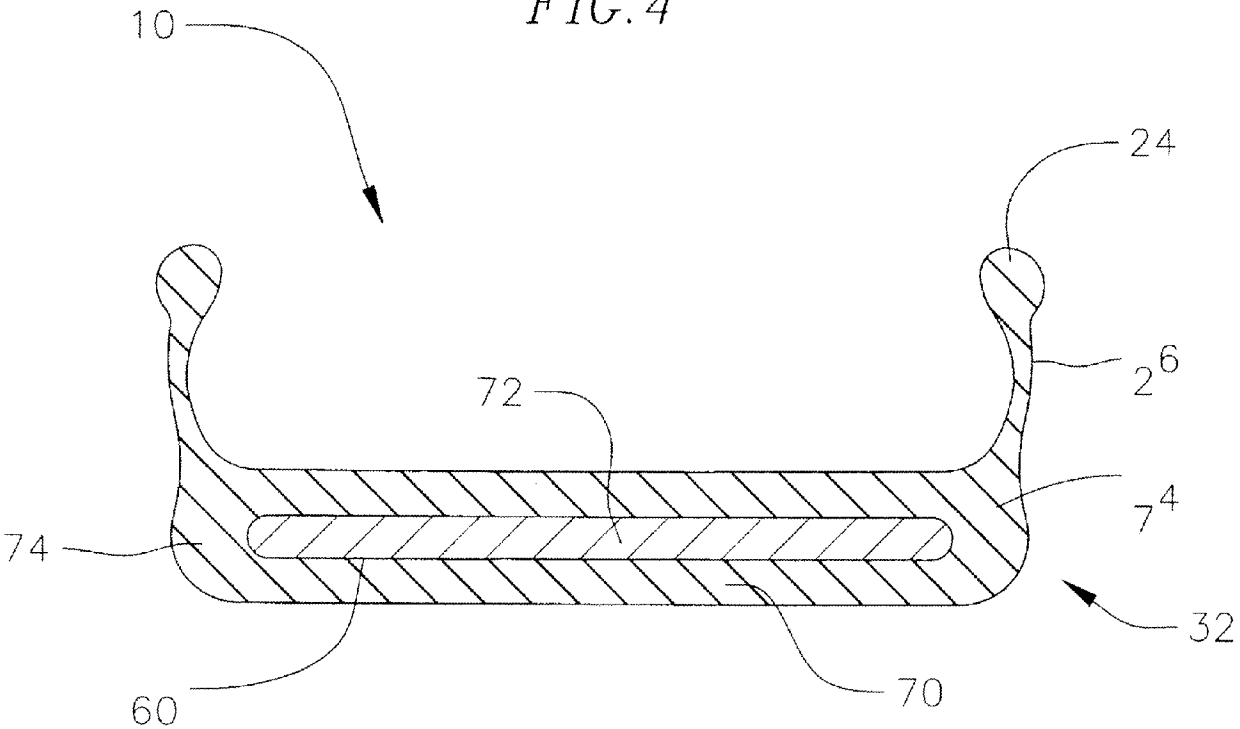
FIG. 4 is a cross-section view of the exemplary shoe cover through view lines 4-4 of FIG. 3.

FIG. 4 is a cross-section view of the exemplary shoe cover 10 through view lines 4-4 in the ball region 32 of the FIG. 3. As can be seen the internal support member 60 is imbedded in the material of the ball region 32, with some rubber material 70 below the internal support member 60 and some rubber material 72 above the internal support member 60. For added stability, at both sides 74 of the sole, the material can be made of thicker material. It is also possible to use a variety of materials, such as with different properties, to control the properties of a shoe cover. For example, for added durability the material at the bottoms of the soles in the ball and heel portions can be of a higher Shore rating, and with the material in other regions made of softer and more flexible material.

Figure 5:
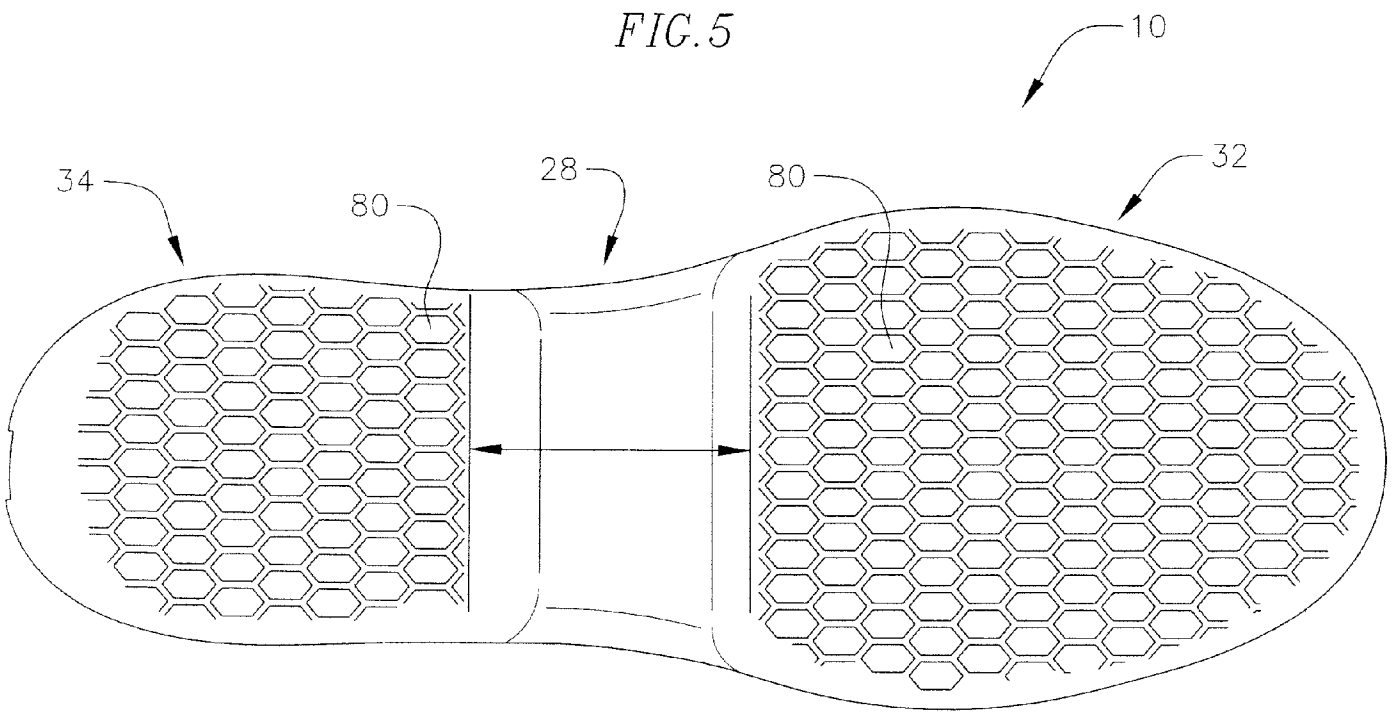
FIG. 5 is a bottom view of the sole of the exemplary shoe cover of FIG. 1.

FIG. 5 is a bottom view of the sole of the exemplary shoe cover 10 of FIG. 1. A traction enhancing pattern 80 can preferably be formed in the ball region 32 and heel region 34. In the midfoot region 28 (in the area of the arch), the material will be thinner than in the ball region 32 and heel region 34, and since normally will not make contact with the ground surface, need not have a friction enhancing pattern formed thereon. As noted above, it is formed of thinner material to provide for lateral stretching between the ball region 32 and heel region 34.

Figure 6:
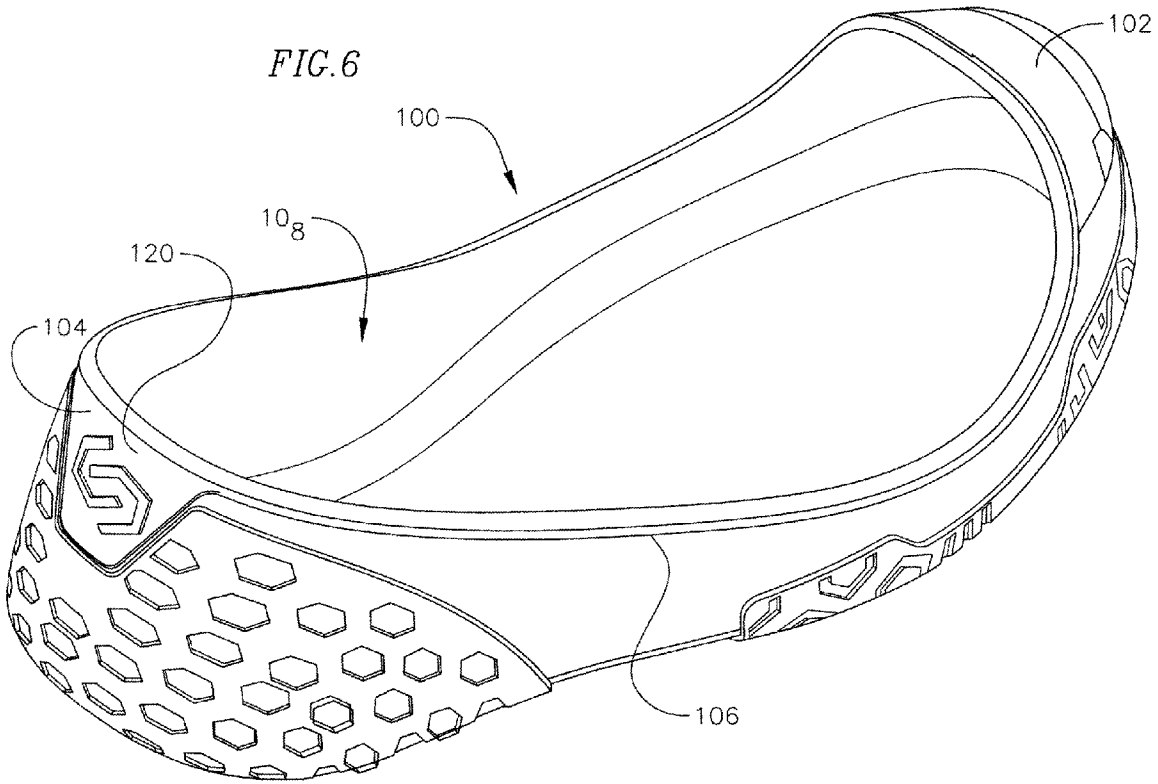
FIG. 6 is a top isometric view showing the inside of another exemplary shoe cover of the invention.
Figure 7:
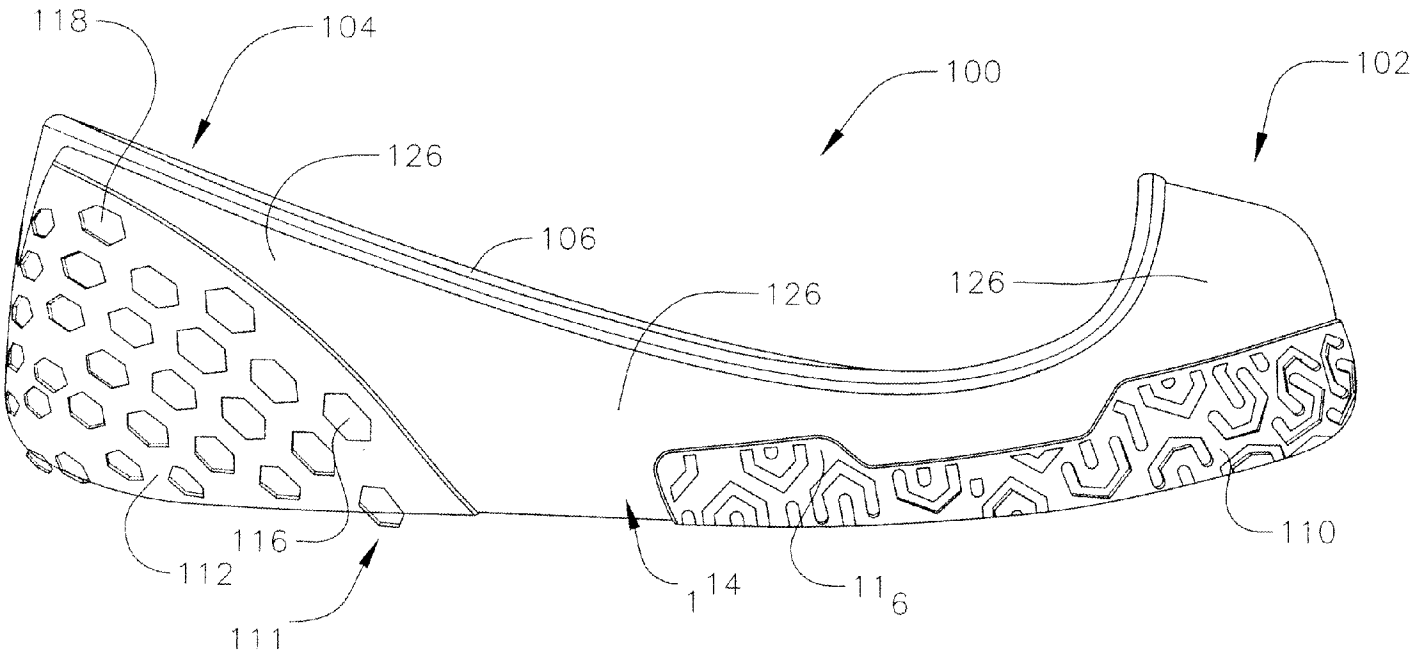
FIG. 7 is a side view of the exemplary shoe cover of FIG. 6.

FIG. 6 is a top isometric view showing the inside of another exemplary shoe cover 100 and FIG. 7 is a side view thereof. The exemplary shoe cover 100 can preferably be formed in a one piece design out of resilient plastic or rubber material that are both flexible and durable. As an example, the following types of materials can be used to form the shoe cover. Petroleum based rubbers, natural rubbers, silicon rubbers and stretch fabrics with or without elastic coatings. Like the first embodiment of the shoe cover 10, shoe cover 100 has a toe cup 102 and a heel cup 104. If desired, a top edge 106 can be formed of thicker material to create a gripping pressure to keep the shoe cover 100 in connection with a user's shoe when inserted into the shoe cover 100 through the shoe cover opening 108. The shoe cover 100 has a sole 111, that has a ball sole area 110, a heel sole area 112, and a midfoot (arch) area 114. In the ball sole area 110 and the heel sole area 112, a traction enhancing pattern 116 is preferably formed thereon. Also, a pattern 118 can be formed on an outside of the heel cup 104. As best shown in FIG. 6, an interruption area 120 in the pattern 118 can be provided at the back of the heel cup 104. This interruption area 120 will provide an area that can receive a logo, etc. Generally all thicker areas of the shoe cover not attributed to sole traction and load-bearing areas are to provide a cupping structure and or increased tension along their path and all thinner areas are there to provide less tension and allow for conforming stretch. As with the embodiment shown in FIG. 1, this embodiment has a thinner area on the outside of the heel that is included to provide a more stretchy, compliant area over the heel of the cleat's upper. In the midfoot area 114, above the ball sole area 110 and extending back to the heel areas 112 above the heel cup 104 with the pattern formed therein, the material forming the shoe cover is thinner, and defines so-called "dynamic stretch areas" 126. In the dynamic stretch areas the material will stretch laterally, longitudinally, and diagonally. This will allow the shoe cover 100 to stretch to fit a variety of shoe sizes and shapes. At the ball sole region 110 and the heel sole region 112, the material can preferably be thicker to help control side to side sole movement. For example, the sole thickness in the ball sole area 112 and heel sole area 114 can be of a desired thickness, such as about 5 to 10 mm, and more preferably about 6.5 to 7 mm, although other thicknesses can be used. Also, the material used to form the sole, if desired, can be made of harder and more durable material. The sole material can be formed of a range of materials, with a desired balance between durability and traction. More durable materials typically are harder and provide less traction. More traction-providing materials are typically less hard and are more susceptible to abrasion.

Figure 8:
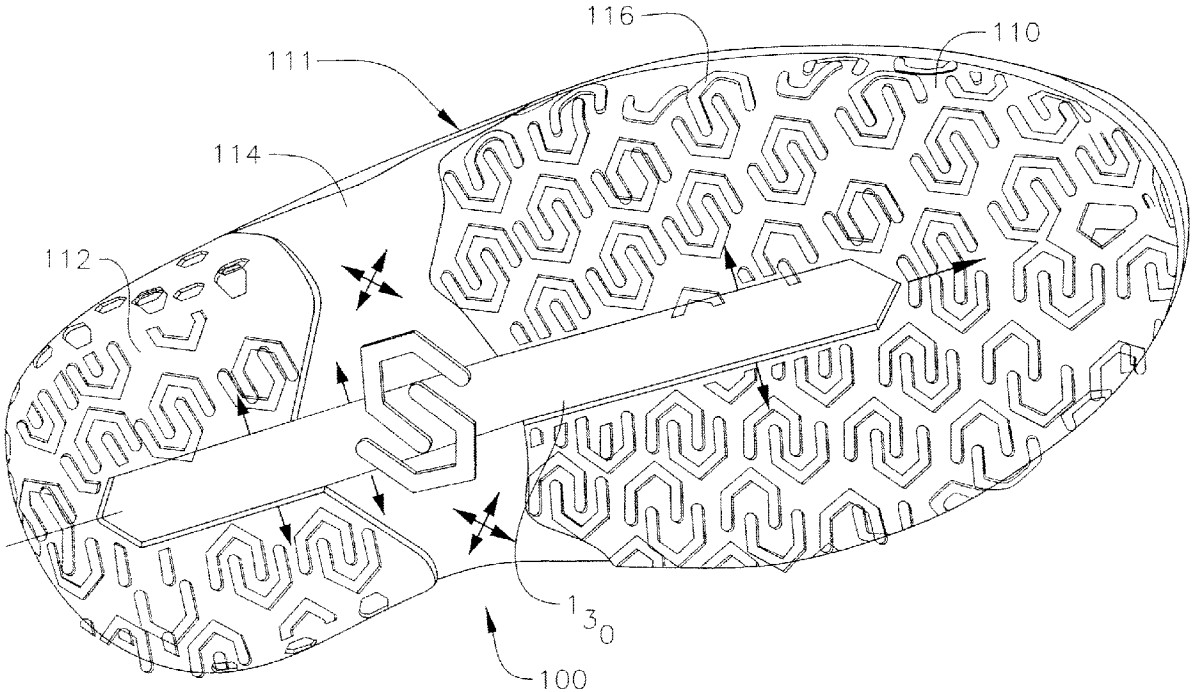
FIG. 8 is a bottom view of the sole of the exemplary shoe cover of FIG. 6.

FIG. 8 is a bottom view of the sole of the exemplary shoe cover 100 of FIG. 6. The friction enhancing pattern 116 is also formed on the underside 116 of the sole 111. In order to provide additional flexibility, a dynamic stretch strip 130 runs longitudinally from the midfoot region 114 into the ball sole region 110 and the heel sole region 112. This helps provide for latitudinal stretch along the longitudinal stretch strip 130. In the mid-foot region 114, the material is thinner and more stretchable, and runs from the lateral to medial sides of the shoe, and continues into the dynamic stretch areas 126, and thus provide for enhanced longitudinal and latitudinal stretching.

Figure 9:
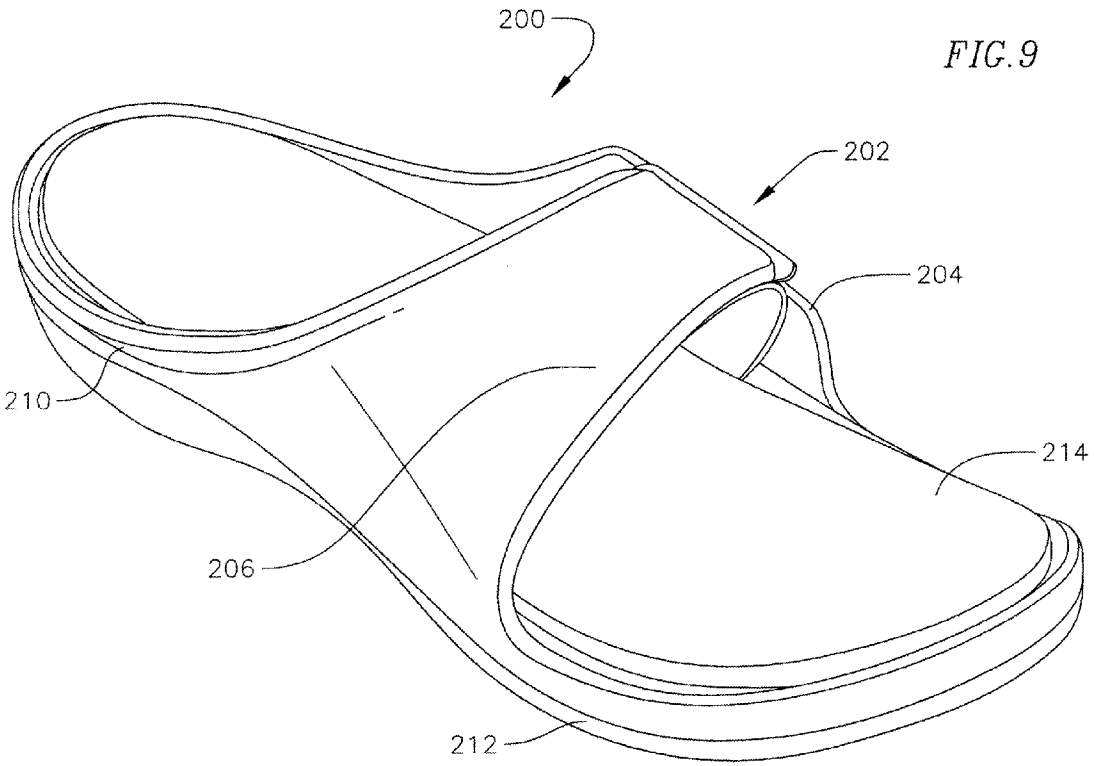
FIG. 9 is a top front isometric view of yet another exemplary embodiment of a shoe cover of the invention.
Figure 10:
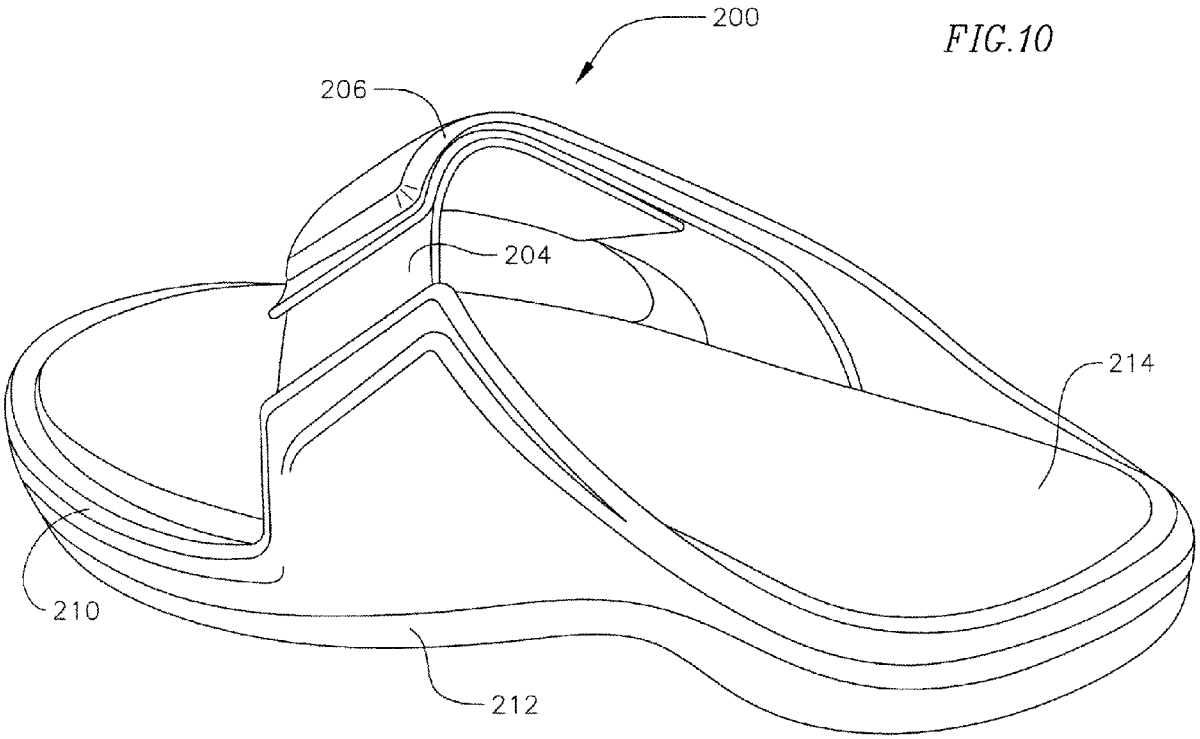
FIG. 10 is a top rear isometric view of the exemplary shoe cover of FIG. 9.

FIG. 9 is top front isometric view and FIG. 10 is a top rear isometric view of yet another exemplary embodiment of a shoe cover 200 of the invention. This shoe cover 200 is adapted to permit a shoe (or foot without a shoe) to slide in through a shoe retention loop 202 that for adjustability sake, can preferably consist of a pair of straps 204 and 206 that detachably attach together with hook and loop type of materials, snaps (not shown), adjustment buckles (not shown) and other known structures on each strap so that when in use, the straps 204 and 206 can be brought together and secured around a user's cleated shoe (not shown.) Since the ability to quickly put on and take off the shoe cover 200 is desirable, detachably attachable straps 204 and 206 are useful. However, in lieu of providing a pair of opposed straps, a single, elastic retention strap that extends across the ball portion of a shoe cover can be provided, to which the user can slide into (not shown). The adjustability allows a wide range of adjustments to be made, and permits easier entry and exit of cleated shoe. For example, the straps 204 and 206 can be loosened up to permit the cleated shoe to be placed on the cleat bed, and the user to step down to compress into the cleat bed. The straps 204 and 206 are then engaged with each other, thereby locking the shoe in place. The shoe cover 200 has a sole frame 210 that extends from a sole region 212 and upwardly to provide portions of the shoe retention loop 202, which will help support the shoe that will be cradled and held therein. The sole frame 210 can preferably be formed form a variety of materials, such as blown rubber, polyurethane foam, injected ethyl vinyl acetate foam and solid rubber. Atop the sole region 212 of the sole frame 210, a cleat bed 214 is provided. This cleat bed 214 is formed of an elastomeric cleat conforming resilient flexible material, such as blown rubber, foam rubber, polyurethane foam and ethyl vinyl acetate foam and will allow cleats or a tread pattern on a user's shoes to selectively press down on selective areas of contact with the cleat bed 214, such as points of contact with cleats, etc. This will help the cleated shoe to be held firmly in place. Even when used for non-cleated shoes, the shoe cover 200 will, by covering the bottom of the soles of the shoe (not shown), prevent the soles of the shoe from making contact with a floor or ground surface. Lastly, the shoe cover 200 can be worn without any shoes, much as a sandals are worn.

Figure 11:
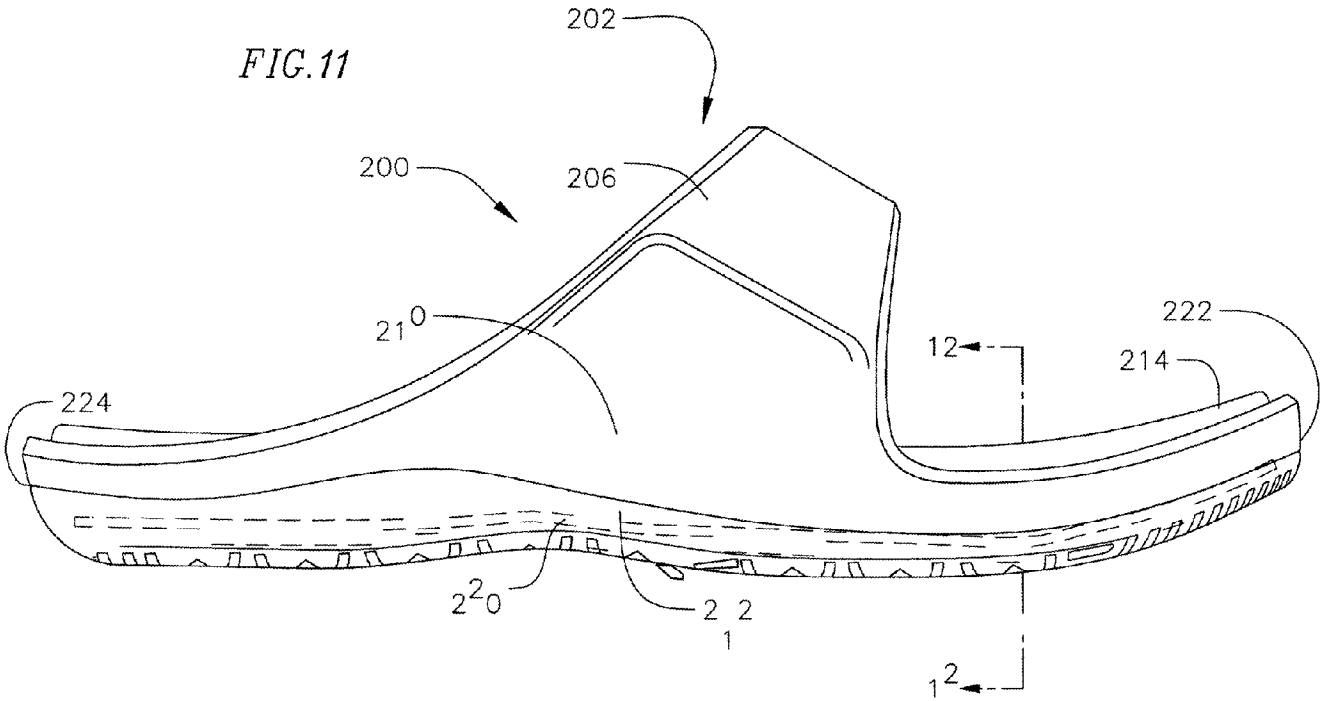
FIG. 11 is a side view of the exemplary shoe cover of FIG. 9.

FIG. 11 is a side view of the exemplary shoe cover 200 of FIG. 9, showing the position of an internal support member 220 which is located either in the sole or on top of the sole between the sole and the cleatbed 214. While shown as extending from the front 222 of the shoe cover 200 to near its rear portion 224, it is possible for there to be interruptions in the internal support member 220. The internal support members 220 can be formed as a rigid or semi-rigid molded plate, as a section of mono filament mesh or a section of fabric, and the like. The function of the internal support member 220 is to strengthen the sole, particularly in the region where the cleats of a wearer's cleated shoes will impinge on the inside of the sole. If a stiffer shoe cover is desired, the internal support member 220 can be formed of thicker and/or stiffer material, such as harder durometer plastic or rubber. In the case of molded internal support member 222, a series of apertures (not shown) can optionally be formed therein. Such apertures will allow rubber to extend through the internal support members and thereby achieve improved anchoring of the molded internal support member in the sole. In the case of the internal support member 220 being formed of a section of mono filament mesh or a section of fabric, by selecting the desired weave of the fabric, there may be some natural passage of material through the filaments. If not, apertures can also be formed therethrough.

Figure 12:
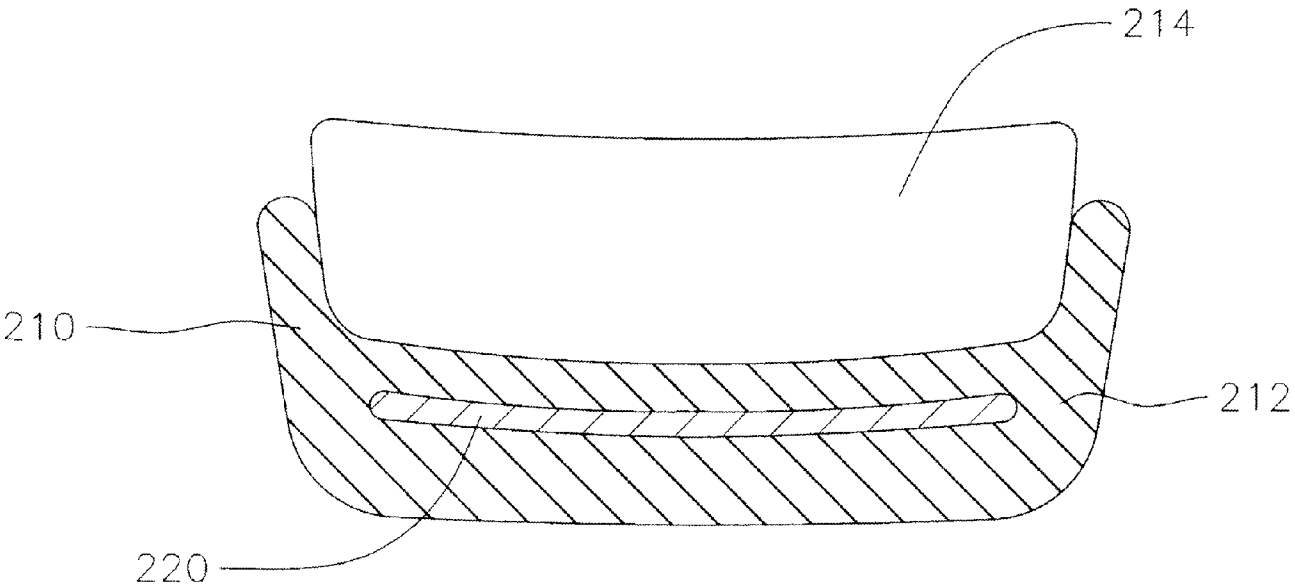
FIG. 12 is a cross-section view of the exemplary shoe cover through view lines 12-12 of FIG. 9.

FIG. 12 is a cross-section view of the exemplary shoe cover 200 through view lines 12-12 of FIG. 9. As can be seen, the internal support member 222 is located in the sole region 212 of the sole frame 210 and is preferably molded therein.

Thus, the shoe covers 10, 100, and 200 of the invention will provide an effective and easy way to use a shoe cover that is easy to put on and take off. While it is desirable that the shoe covers 10, 100, and 200 come in a wide variety of sizes to fit the shoes they will be used to cover, it is not absolutely required, and they can be made in a greater variety of sizes and shapes to closely conform to a given shoe style and size. Also, while the shoe covers 10, 100, and 200 are particularly well suited to cleated shoes, they can be used even with non-cleated shoes, such as when a person wishes to wear his or her shoes indoor but want to protect flooring from tracked in dirt, etc., or without shoes, much as sandals are worn.

Having thus described exemplary embodiments of the present invention, it should be understood by those skilled in the art that the above disclosures are exemplary only and that various other alternatives, adaptations and modifications may be made within the scope of the present invention. The presently disclosed embodiments are to be considered in all respects as illustrative and not restrictive.

What is claimed is:

1. A shoe cover for use with a cleated shoes, comprising:

a sole portion having a ball area, a heel area, and a mid-foot area between the ball area and the heel area, the ball area and heel area being formed without any pre-designated recesses formed therein to receive the cleats, with at least the mid-foot area being formed of stretchable material and being thinner than the ball area and heel of the sole, and wherein the sole portion is without cutouts formed therein;

an internal support member located internally only in the ball area and/or heel area of the sole, below an upper surface of the ball area and/or heel area, the support member comprising a material that is harder than the material used to form the sole portion, the support member being placed and adapted to spread a load of point-load pressure of all of cleat tips of the cleated shoe located above the ball area and/or heel area, over a broader area of the sole; wherein the sole portion in the ball area and/or heel area has a thickness in the range of 5 mm to 10 mm and comprises of a stretchable material, a portion of which that is located above the support member being adapted to make contact with the cleats and allow the cleats to press therethrough and displace the stretchable material to form a wall around all of the cleat tips so that the cleat tips rest on top of the support member; and an upper portion that extends upward from the sole portion and defines a toe cup and a heel cup, with the upper portion being formed of stretchable material in at least the mid-foot area, and which has an opening formed therein to allow shoe and/or foot access to the shoe cover.

2. The shoe cover of claim 1, wherein the upper portion is thicker along an uppermost edge thereof.

3. The shoe cover of claim 1, wherein the sole portion and the upper portion are formed together as a unitary molded body.

4. The shoe cover of claim 1, wherein traction enhanced surfaces are formed on the inside of the shoe cover above the ball area and the heel area of the sole, and a traction enhanced area is formed at a back of heel cup of the shoe cover.

5. The shoe cover of claim 2, wherein a rearmost portion of the heel cup has an upwardly extending high heel riser portion, and has a friction enhancing surface located on an inside surface of the heel cup.

6. The shoe cover of claim 1, wherein the upper portion is formed of dynamic stretchable material in the mid-foot area and extending into the ball region and the heel region.

7. The shoe cover of claim 1, wherein the upper portion is formed of dynamic stretchable material in the mid-foot area and extending into the ball region and toe cup, and into the heel region.

8. The shoe cover of claim 1, wherein a dynamic stretch band is located in the form of an elongate strip oriented longitudinally on a bottom of the sole, and extends frontwardly and rearwardly from the mid-foot regions of the sole, wherein the dynamic stretch band is adapted to permit the shoe cover to be stretched both lengthwise and widthwise.

9. The shoe cover of claim 1, wherein a dynamic stretch band is located in the mid-foot region of the sole, and extends around to the upper of the shoe.

10. The shoe cover of claim 1, wherein the heel cup has an area of thin dynamic stretch material formed at uppermost and rearmost areas.

11. The shoe cover of claim 1, further comprising a friction enhancing pattern formed on the outside of the heel cup.

12. The shoe cover of claim 1, wherein the internal support member includes a plurality of apertures configured to allow a material forming the ball area and/or heel area of the sole to extend through the plurality of apertures to provide improved anchoring of the internal support in the sole.

13. A shoe cover for cleated shoes, comprising:

a sole frame portion having a sole portion and an upper portion that rises about the sole portion, the sole portion having a support member formed by a material that is harder than the material used to form the sole portion molded internally therein below an upper surface of the sole frame portion, the support member being placed and adapted to spread a load of point-load pressure of the tips of all of the cleats of the cleated shoe located above the support member, over a broader area, wherein the material of the sole portion located above the support member being placed and adapted to make contact with tips of the all of the cleats located above the support member and allow said cleats to press therethrough and displace the material to form a wall around the cleats and rest on top of the support member, wherein the sole frame has a thickness in the range of 5 mm to 10 mm and wherein the upper surface of the sole portion being formed without any pre-designated recesses formed therein to receive the cleats;

straps regions that extend from upper portion, which straps have attachable detachment means located thereon to selectively attached and detach the straps together; and a cleat bed that is located above the sole portion in the sole frame, the cleat bed being formed of elastomeric material.

14. The shoe cover of claim 13, wherein the attachable detachment means comprise hook an loop material.

15. The shoe cover of claim 13, wherein the straps comprise stretchable material.

16. The shoe cover of claim 13, wherein the support member includes a plurality of apertures configured to allow a material forming the sole portion to extend through the plurality of apertures to provide improved anchoring of the internal support in the sole.

* * * * *